United States Patent [19]

Eaton et al.

[11] 3,941,518

[45] Mar. 2, 1976

[54] STEAM-SPRAY IRON

[75] Inventors: John L. Eaton, Delanco, N.J.; John C. Fagan, Philadelphia; Roger V. Eeckhout, Warminster, both of Pa.

[73] Assignee: SCM Corporation, New York, N.Y.

[22] Filed: Feb. 18, 1975

[21] Appl. No.: 550,705

Related U.S. Application Data

[62] Division of Ser. No. 363,965, May 25, 1973, Pat. No. 3,881,265.

[52] U.S. Cl. ..... 417/442

[51] Int. Cl.[2] ..... F04B 21/00

[58] Field of Search ..... 417/442, 234, 470, 471, 417/572, 437

[56] References Cited

UNITED STATES PATENTS

| | | | |
|---|---|---|---|
| 288,030 | 11/1883 | Dean | 294/65 |
| 2,016,503 | 10/1935 | Kenworthy | 417/442 |
| 2,531,980 | 11/1950 | Johnson | 417/442 |

*Primary Examiner*—William L. Freeh
*Assistant Examiner*—G. L. LaPointe
*Attorney, Agent, or Firm*—Leitner, Palan & Martin

[57] ABSTRACT

An electric steam-spray iron having a pump and a bistable valve in a single housing for drawing water from a reservoir and delivering it to either a spray nozzle or a steam generating chamber which communicates with steam ports in the sole plate. The valve's stable state is changed by rocking movement of the pump's piston.

9 Claims, 8 Drawing Figures

STEAM-SPRAY IRON

This is a divisional of application Ser. No. 363,965, filed May 25, 1973, now U.S. Pat. No. 3,881,265.

BACKGROUND OF THE INVENTION

The present invention relates generally to the electric iron art and more specifically to the combination steam and spray electrical irons.

DESCRIPTION OF THE PRIOR ART

In the field of electric irons, there have been many devices combined in the housing of the electric iron to provide moisture to the item to be ironed. These devices have included a nozzle to spray water droplets onto the object to be ironed in the path of the iron. Also, many irons have provided a needle valve which allows small droplets of water to enter a steam generating chamber to provide a continuous steam through steam ports in the sole plate of the iron. Along with the water spray and the continuous steam, irons have been developed which include a deep penetrating steam produced by introduction of a large amount of water into a steam generating chamber to produce a high velocity steam for the removal of stubborn wrinkles or for deep penetration of thick fabrics.

The moisture producing electric irons fall within two basic categories, i.e. steam pressure-type and the manual pump-type. In the steam pressure type, some of the normal steam is diverted by a valve up to the spray nozzle and this steam flow aspirates water from the tank so that a spray of water and steam emerges from the nozzle.

The second type of moisture producing iron, namely the manual pump type, has become more popular in the marketplace and is the subject of the present invention. In this type of iron, water which is withdrawn from a reservoir by a manual piston pump is delivered to either a spray nozzle or to a steam generating chamber which communicates with the steam outlets in the sole plate. The manual pump irons of the prior art (for example, U.S. Pat. Nos. 3,599,357 and 3,691,660) have involved rotation of a member to operate multiple valves or to relocate a sliding sleeve port.

In utilizing the iron of the prior art, one must either hold the iron with one hand and make the selection of mode of moisture delivery with the other hand, or else must place the iron in its rest position and make this selection. Thus, in order to make a moisture mode selection, the user must interrupt her normal ironing process. This interruption for selecting the state of the moisture to be delivered is annoying and time consuming.

Objects and Summary of the Invention

Thus it is a primary object of the present invention to provide a pump and moisture selection means in a single housing with a reduced number of parts.

Another object of the invention is to increase reliability by reduction of the number of parts.

A further object of the invention is to provide a steam-spray iron which is easy to use and uncomplicated to the normal user.

Still another object of the present invention is to provide an improved electrical steam-spray iron having a combined pump and valve mechanism wherein rocking movement of the piston selects the path of discharge, either to the spray mechanism or into the steam generating chamber.

An even further object of the invention is to provide steam-spray iron which has a bi-stable valve mechanism operable without interruption of the ironing process.

The objectives outlined above, as well as other objects and features of the present invention, are accomplished by an improved steam-spray iron wherein a bi-stable valve and a manual piston pump share a common housing whereby movement of the pump handle provides a selection of the bi-stable valve's stable state and also provides the manual pump action. The bi-stable valve determines whether the water drawn from the reservoir by the pump is distributed to the spray nozzle or down into a steam generating chamber to produce a high velocity steam through steam ports in the sole plate. Rocking movement of the manual pump handle is transmitted to a valve rocker by a spring biased actuator telescopically received within the face of the piston. The valve rocker sits in the base of the combined pump and valve housing and has a center fulcrum which causes the rocker to have only two stable positions. The outlets in the base of the combined housing directs the water either to the spray nozzle or into the steam generating chamber to produce high velocity steam. The lateral selection movement of the pump handle may be made by the user with a single finger, preferably the same finger which operates the pump, and may be made without interruption of the ironing process.

DESCRIPTION OF PREFERRED EMBODIMENTS

Figure 1:
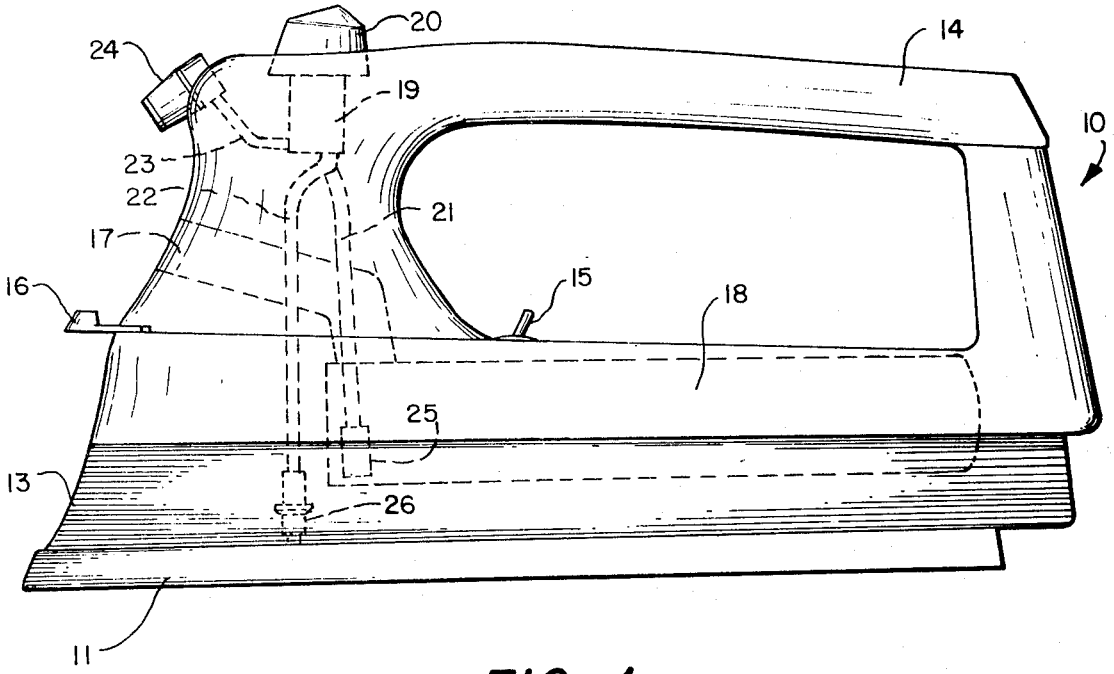
FIG. 1 is a diagrammatic view showing the manner in which the steam spray device of the invention is mounted within the body of an electric iron.

Referring to FIG. 1, an electrical steam-spray iron 10 is shown incorporating the combination pump and valve mechanism of the present invention. The iron 10 includes a sole plate 11 having a plurality of steam ports (not shown) therein. Supported above the sole plate 11 is case 13 and handle 14. A continuous steam switch 15 is shown in the top part of the casing 13 which is used to control a needle valve (not shown) which provides a small gravity flow of water from the reservoir into a steam generating chamber to produce a continuous steam through the steam ports. The assembly to produce this constant steam has been eliminated from the drawings in order to avoid confusion with the present invention.

The front of the housing having a temperature selection switch 16 which controls a thermostatically controlled switch in the body, also is not shown. Conduit 17 provides a means for inserting water through the face of the iron down into reservoir 18.

The combined pump and valve housing 19 contained within the handle has a button 20 which is used to manually activate the pump and to select the position of the bi-stable valve. A tube or pipe 21 connects the reservoir 18 with the inlet to the combined pump valve housing 19. The two outlets for the pump and valve housing 19 are connected to a steam generating chamber by tube 22 and to spray nozzle 24 by tube 23. At the end of tube 21 which rests within reservoir 18, a combined filter and check valve 25 is provided. Also, on the end of tube 22 connecting the combined pump and valve housing 19 with the steam generating chamber, a unique check valve 26, discussed in more detail later, is used. It should be noted that spray nozzle 24 also has a unique check valve enclosed therein which will also be discussed later.

Iron 10 in FIG. 1 operates in four basic modes. The first mode is a dry mode wherein switch 15 is switched to the dry position which closes a needle valve to prevent water dripping into a steam generating chamber. The second mode is a steady, continuous steam produced by moving switch 15 to the steam mode and allowing water to drip one drop at a time into a steam generating chamber. The third and fourth modes are selected by pump button 20 through the operation of combined pump and valve housing 19. The third mode is the production of water from spray nozzle 24 selected by lateral or rocking movement of pump button 20. Once the button 20 has been moved left, as viewed in FIG. 1 to move the bi-stable valve to a first stable position, upward movement of the pump button draws water from reservoir 18 through filter 25 to tube 21 into the housing 19 and downward movement forces the water out of the housing through tube 23 to spray nozzle 24. The fourth mode of operation produces a high velocity steam in which button 20 is rocked in the opposite direction to move the bi-stable valve to a second stable position so as to allow water to be withdrawn from reservoir 18 through filter 25, tube 21, and into valve housing 19 by an upward movement and then to be delivered through tube 22 and check valve 26 into a steam generating chamber by a downward movement. It is apparent from FIG. 1 that the selection of the third or fourth mode may be made by the user's thumb, which may be the same finger used for the up-down pump action. Both of these motions of the thumb are made simultaneously with the use of the iron and without interruption of the ironing process.

A more detailed explanation of the workings and contents of the combination pump and valve mechanism in relationship to the spray nozzle, the reservoir and the steam generating chamber will be described with reference to FIGS. 2–4. The pump button 20 is shown as having an inverted U-shaped section with a center member 28. The center member 28 has a bore 27 for receiving piston rod 33 of piston 32 therein. Secured to the top of pump button 20 may be a metal plate 29 which exhibits indicia for aiding the user in selecting spray or high velocity steam modes.

The combined pump and valve housing 19 is composed of two members, i.e. pump housing 30 and pump base 40. The two pieces are press fitted together to provide a tight seal therebetween. The housing 30 has an aperture 31 in the top thereof for receiving piston rod 33 and for permitting the rocking motion of the piston rod. Piston 32 is preferably formed of a single piece of material having a piston rod 33 and a head 34. The head 34 has a circumferential recess in which rests C-ring or any other sealing medium 35 which provides a seal between the piston head 34 and the pump housing 30. The O-ring may be coated with a lubricant to facilitate the movement of the piston within the pump housing.

In the face of the piston head 34, an aperture 36, which continues into the piston rod 33, receives the actuator 37 therein. The diameter of the actuator 37 is smaller than the diameter of the aperture 36 such that the actuator 37 is telescopically received within the piston 32 and moves freely therein. The actuator 37 is shown as having a modified conical head 38 with sides cooperating to form angular surfaces having a partially rounded tip.

Figure 6:
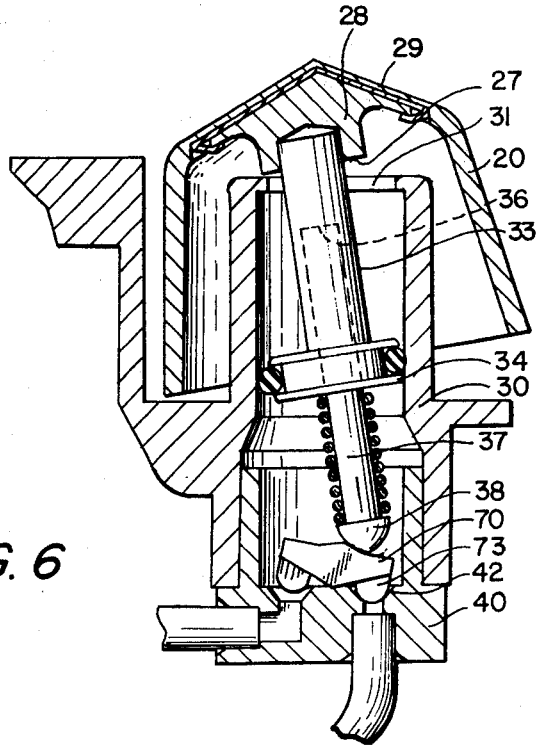
FIG. 6 is a sectional cut-away view showing the pump handle in the down position and the bi-stable valve in the second stable state.

It is the shape of actuator head 38 which forms an important camming surface to be used in combination with valve rocker 70 to provide the bi-stable operation of the valve to be explained hereafter. Spring 39 between the face of piston head 34 and the base of actuator conical head 38 provides a biasing means which urges the separation of the actuator 37 from the piston 32. It should be obvious that the biasing means 39 may also be placed in aperture 36. Besides keeping the actuator 37 in contact with valve rocker 70, biasing means 39 also produces the upward or return movement of the pump button 20. As mentioned previously, the aperture or bore 36 in the piston 32 is deep enough so as to allow the piston to travel its full stroke while telescopically receiving the valve actuator 37 as shown in FIG. 6.

In the internal bottom of pump base 40 lies tapered valve seats 41 and 42, the openings of which communicate with external outlets 43 and 44, respectively. Inserted into outlet 43 is tube 23 leading to the spray nozzle 24 and in outlet 44 is inserted tube 22 leading to the steam generation chamber. Internal to pump housing 30 is inlet 45 communicating with an external inlet 46 having tube 21 inserted therein which communicates with the reservoir 18. As the pump moves up, water is drawn from the reservoir through tube 21, inlets 46 and 45 into the combined pump and valve housing 19. On the downstroke, the water in the housing is forced through one of the openings of valve seats 41 or 42 and into its respective tubes 23 or 22. The outlet through which the water exits the pump base 40 is determined by the position of bi-stable rocker 70. As shown in FIG. 2, the water will exit out of opening 42, outlet 44, and down into tube 22 to the steam generation chamber.

Figure 3A:
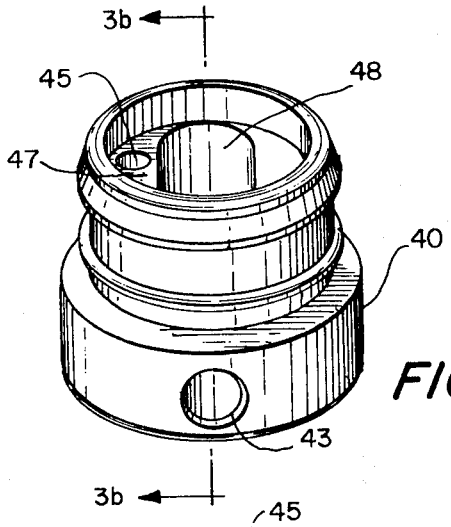
FIGS. 3*a* and 3*b* are perspective and sectional views, respectively, of the combined pump and valve housing base.
Figure 3B:
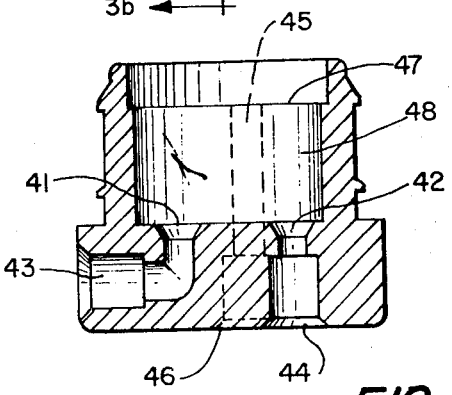

An examination of FIGS. 3*a* and 3*b* will reveal the precise relationship of the inlet, outlets, and openings and tapered valve seats of the pump base 40. The pump base 40 has an internal structure or member 47 having a slot or recess 48 therein. The valve seats 41 and 42 are in the bottom of said slot or recess and the inlet 46 communicates with the internal inlet 45 at the top of internal member 47. The slot or recess 48 provides a seat for rocker 70 and also provides a stop for actuator head 38, thereby limiting the movement of the combination actuator and thus the piston to lateral movement within the slot or recess 48. The recess does not interfere or in any way limit the vertical pumping action.

Figure 2:
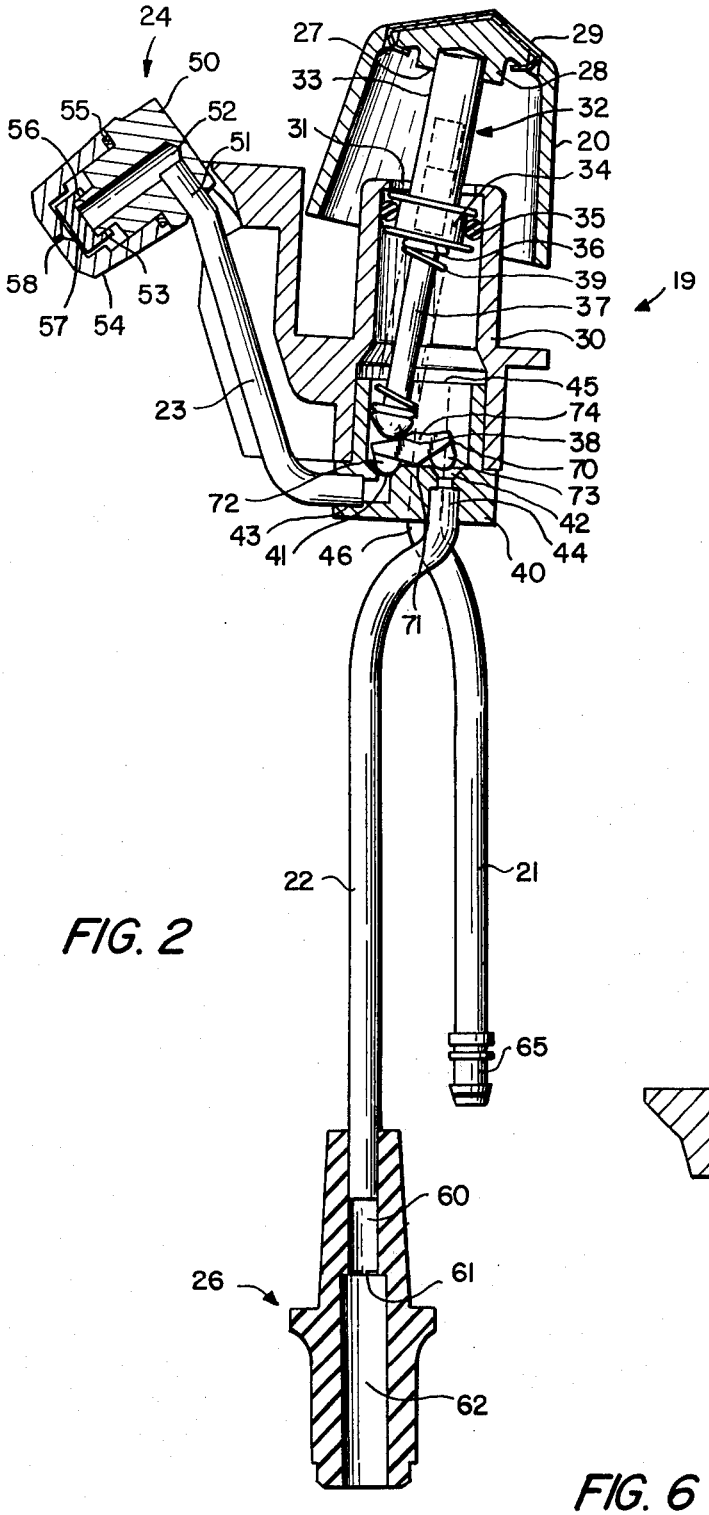
FIG. 2 is a sectional view of parts broken away, showing on a larger scale the combined pump valve housing communicating with the spray and steam producing devices.

The spray nozzle 24, as shown in FIG. 2, comprises a base or body 50 which threadably receives nozzle 54 which has an aperture 58 therein. A gasket 55 provides a water-tight seal between the nozzle 54 and the nozzle base 50. On one side of the nozzle base 50 is an inlet 51 for receiving tube 23 which brings water from the combination pump and valve housing 19. Tube 23 and inlet 51 communicate with a duct 52 in the center of the nozzle base 50. Encompassing the end of said duct is a flexible cap valve 53, preferably made of an elastomeric material. The cap valve 53 surrounds the projected exterior of the base at the circumferal surface 56. This cap functions as a check valve, allowing water to flow from duct 52 into the interior of the nozzle 54 and out of aperture 58 on the downward stroke of the pump and sealing the end of duct 52 on the reverse stroke of the pump, thus preventing air from being conveyed through tube 23 into the pump and valve housing.

To be more specific, in the pressurized or downward movement of the piston, water is forced from the tube 23 into duct 52. The water being pressurized forces the flexible cap 53 to deform and separate from base 50 at circumferal surface 56 and water will flow therefrom. On the inside of nozzle 54, there are channels 57 which allow the water that flows out at the circumferal surface 56 to exit from nozzle 58. Upon the reverse stroke of the piston, the cap 53 is sucked or moved back into contact covering duct 52, thereby re-establishing an airtight surface 56 between the cap 53 and the housing 50. Though valve cap 53 is used in the present spray nozzle 24, any other check valve system may be employed to allow water to enter the nozzle in the downstroke of the pump and to seal the nozzle to prevent air from being injected into the pump during its upstroke.

Another novel check valve 26, shown in FIG. 2, is mounted on the end of tube 22 leading from the housing into the steam generation chamber. The interior of the check valve 26 consists of an upper internal bore 60 and a lower internal bore 62 separated by diaphragm 61. The diameter of upper bore 60 is smaller than the diameter of the lower bore 62. Diaphragm 61 has a slit across its diameter. Due to the relative size of the upper and lower bores, 60 and 62, and the flexibility of diaphragm 61 with a slit therein, the diaphragm deforms and opens allowing water under pressure to proceed from tube 22 into a steam generating chamber and it resumes its normal shape and closes the slit upon reverse pressure to prevent water or steam from re-entering tube 22 during the reverse action of the pump. The total body of check valve 26 is comprised of a flexible material and the exterior is shaped so as to provide a water-tight seal with the steam generating chamber. Obviously, any standard check valve may be utilized on the end of tube 22.

A coupling 65 is mounted on the end of tube 21 to receive and maintain the combination filter and check valve 25. The filter and check valve, which is more fully discussed below, functions to allow water to be drawn from the reservoir into the pump and valve housing 19 during the upstroke of the pump and to prevent water from leaving the pump housing 19 and re-entering the reservoir. It also prevents residue in the water from leaving the reservoir.

Figure 4A:
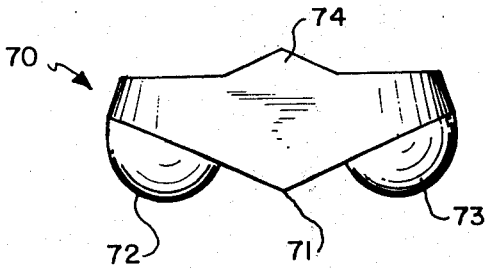
FIGS. 4*a* and 4*b* are perspective and side views, respectively, of the valve rocker.
Figure 4B:
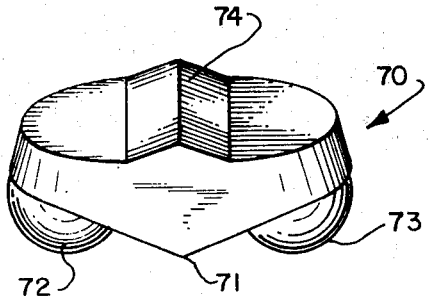

The major component of the bi-stable valve is rocker 70, shown in FIG. 2 and shown still more explicitly in FIGS. 4*a* and 4*b*. The rocker 70 has a body including a fulcrum surface 71 which lies upon the bottom of the slot or recess 48 in the pump base 40. On either side of fulcrum 71 are two hemispherical protuberances 72 and 73 extending from the body. These protrusions are received in openings 41 and 42 of the pump base 40 which are tapered to form seats for the rocker protruberances 72 and 73. On the top surface of the rocker 70 is an angular cam surface or protrusion 74 having the form of an obtuse angle. As can be seen from FIG. 4*b*, the rocker 70 is of the same shape as the slot or recess 48 of the pump base. This allows the rocker to sit in the base and teeter therein while preventing angular movement of the rocker. It should be noted that the protrusions 72 and 73 project from the angular surfaces of the body which form the fulcrum 71.

When the rocker 70 is placed within the recess of the pump base, it will not naturally assume a position other than tilted fully in one direction or the other because of the tapered seats 41 and 42 and the fulcrum 71. Only a force applied perpendicular to horizontal at the apex of cam surface 74 will allow the rocker to assume a totally horizontal position where neither of the protrusions 72 or 73 are fully seated within openings 41 or 42. To revent the rocker from being held in this horizontal position, or to allow the rocker to assume only its two stable states, thereby being purely bi-stable, the actuator 37 has the conical head 38 which continuously engages angular cam surface 74 because of the action of biasing member 39. Since cam surface 74 and actuator head 38 both form angular surfaces, the two members when forced together cannot assume a stable state with their respective apexes' mating. Consequently, the conical head 38 must rest on one side of the apex of cam surface 74 or the other. Thus, the interaction of the spring biased actuator against the rocker 70 provides a truly bi-stable valve switching mechanism.

As can be seen clearly in FIG. 2, by moving the pump button or handle 20 laterally to the right, the spring biased actuator slides to the left of cam surface 74 and forces protrusion 72 into opening and seat 41 thereby sealing outlet 43. The actuator 37 and its head 38, and rocker 70, retain this position during the up-down motion of the pump handle. To change the valve to its other bi-stable state, the pump button 20 is moved laterally to the left whereby actuator head 38 rides over the apex of cam surface 74 and slides down on the right side of cam surface 74, forcing protrusion 73 to seat in opening 42, thereby sealing outlet 44. This position is shown in FIG. 6. As in the other position, actuator 37 is received telescopically within aperture 36 of the piston of the pump. The valve rocker 70 remains in this stable state during the pumping action of the pump button. FIG. 6 also shows the pump button 20 surrounding the pump housing 30 when the pump button is in the fully down position of the pump action.

It can be plainly seen from FIGS. 2 and 6 that the valve of the present invention is truly bi-stable, having its stable position selected by lateral movement of the pump handle or button by the ironer using a single finger. Thus the present bi-stable valve in a combined pump housing reduces the number of movable parts and also the number of individual selectors and dials that the user must actuate during the operation of the iron.

Figure 5:
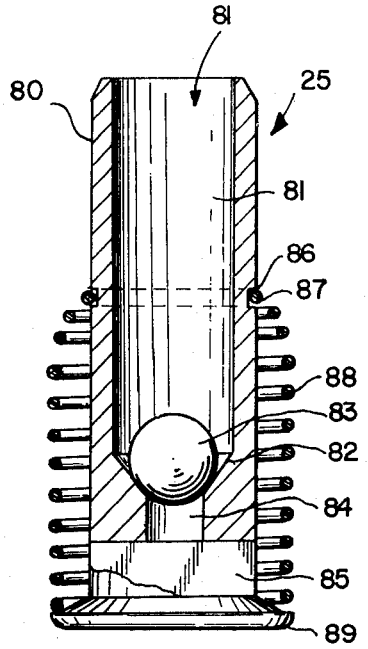
FIG. 5 is a sectional view of the combined check valve and water filter.

FIG. 5 shows the combination filter and check valve 25 which is received on coupling 65 at the end of tube 21. The combination filter and check valve has a housing 80 with a bottom 89 which is adjacent the bottom of the reservoir 18. Parallel to the bottom 89 is a bore 85 extending diametrically through the housing 80. Location of bore 85 at the bottom of the housing 80 allows for all the water in the reservoir to be received within the filter-check valve for use in the moisture systems of the present iron. Communicating with horizontal bore 85 is a vertical bore 84 which communicates with the seat 82 of the check valve formed by an inclined surface narrowing the diameter of major bore 81. A sphere 83 is contained within bore 81 and is received at seat 82 to seal bore 84. Functioning as a check valve, an upward force draws sphere 83 up and allows water to be drawn up through bore 81 into tube 21. Upon a downward pressure, the ball 83 is seated in seat 82 and seals bore 84 to prevent water from re-entering the reservoir through horizontal bore 85.

One of the novel features of the present combination check valve and filter is the use of a spiral wire 88 surrounding the body of the check valve 80 for preventing debris in the reservoir from entering the check valve and the follow on system including the pump housing. The wire coil has a plurality of turns wherein the top turn 87 is received within notch 86 of the check valve housing 80. The spiral wire has smaller or tighter turns at the top and thus tapered assumes a substantially constant diameter later on which is displaced and parallel to the body 80. The spring rests on bottom 89 of the check valve body 80. The space between the spiral elements 88 is sufficient to allow water to enter horizontal bore 85, yet small enough to prevent large pieces of debris from entering the check valve.

The present combination filter and check valve 25 may be replaced by standard filters and check valves and check valve 26 and valve cap 53 may also be replaced by standard check valves. Though those three mentioned check valves may be replaced by standard check valves, they provide three novel approaches to inexpensive and effective check valves which have a function other than merely regulating the flow, thus reducing the number of parts and the amount of space needed.

As mentioned previously, the present steam-spray iron provides four modes of operation. These modes are dry, constant steam, atomized spray, and a high velocity steam. The inventive combination pump and bi-stable valve of the present invention allows for selection between the atomized spray and the high velocity steam by mere lateral movement of the pump handle or button. Also included herein are three novel check valve systems for use in combination with the pump-bi-stable valve.

Although the invention has been described and illustrated in detail, it is to be clearly understood that the same is by way of illustration and example only and is not intended to be taken by way of limitation, the spirit and scope of this invention being limited only by the terms of the appended claims.

What is claimed is:

1. A pump comprising a housing, a piston within said housing, an actuator having a first end telescopically engaging said piston and a second end, a biasing means between said piston and said actuator for urging separation of said telescopic engagement, a plurality of outlets on the inside bottom of said housing, a rocker means within said housing for covering and uncovering said plurality of outlets individually in response to said actuator's second end, and an inlet.

2. A pump as in claim 1 wherein said rocker means comprises a body, a first protrusion extending from a first side of said body for engagement with said housings' inside bottom, and a second protrusion extending from a side opposite said body's first side for engagement with said actuator's second end.

3. A pump as in claim 2 wherein said first and second protrusions are substantially triangular and said actuator's second end is substantial conical.

4. A pump as in claim 3 wherein said biasing means comprises a spring having a first end engaging a face of said piston and a second end engaging a base of said actuator's conical end.

5. A pump as in claim 2 wherein said outlets are two, said rocker body having two valve closing means for closing said outlets.

6. A pump as in claim 5 wherein said valve closing means comprises a protruberance.

7. A pump as in claim 5 wherein said second protrusion and said actuators second end are cooperating angular surfaces rendering said rocker means bi-stable.

8. A pump as in claim 7 wherein said rocker and said actuator's second end are disposed in a recess in said housing so as to limit said rocker means' and said actuator's motion to a single plane, and said two outlets being in the bottom of said recess.

9. A pump as in claim 8 wherein said inlet is external to said recess.

* * * * *